US009494903B2

(12) United States Patent
Shinagawa et al.

(10) Patent No.: US 9,494,903 B2
(45) Date of Patent: Nov. 15, 2016

(54) IMAGE FORMING APPARATUS WITH CLEANING MODE

(71) Applicant: CANON KABUSHIKI KAISHA, Tokyo (JP)

(72) Inventors: Akiyoshi Shinagawa, Kasukabe (JP); Oki Kitagawa, Nagareyama (JP); Masanobu Tanaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/876,304

(22) Filed: Oct. 6, 2015

(65) Prior Publication Data

US 2016/0098004 A1 Apr. 7, 2016

(30) Foreign Application Priority Data

Oct. 7, 2014 (JP) ..... 2014-206273

(51) Int. Cl.
*G03G 15/20* (2006.01)
*G03G 15/00* (2006.01)

(52) U.S. Cl.
CPC ..... *G03G 15/2085* (2013.01); *G03G 15/2025* (2013.01); *G03G 15/2075* (2013.01); *G03G 15/5016* (2013.01); *G03G 2215/00531* (2013.01); *G03G 2215/0129* (2013.01); *G03G 2215/2032* (2013.01)

(58) Field of Classification Search
USPC ..... 399/67–71, 122, 123, 320, 327
See application file for complete search history.

(56) References Cited

U.S. PATENT DOCUMENTS 5,958,559 A 9/1999 Torikoshi et al.
9,081,341 B2 * 7/2015 Sugaya ..... G03G 15/2053

FOREIGN PATENT DOCUMENTS

JP 09-160276 A 6/1997
JP 2009-058821 * 3/2009

* cited by examiner

*Primary Examiner* — Hoan Tran
(74) *Attorney, Agent, or Firm* — Fitzpatrick, Cella, Harper & Scinto

(57) ABSTRACT

An image forming apparatus includes: an image forming device configured to form a toner image on a sheet; a fixing device configured to fix the toner image formed on the sheet by the image forming device at a nip; an executing portion configured to execute an operation in a cleaning mode for cleaning the fixing device by forming a predetermined toner image on a sheet using the image forming device and then by introducing the sheet into the nip; and a notifying device for notifying an operator that a maximum-width sheet usable in the image forming device is to be used in the operation in the cleaning mode.

17 Claims, 16 Drawing Sheets

(a)

| | SIZE | WIDTH | LENGTH | CLEANING |
|---|---|---|---|---|
| FEEDER 1 | 330＊483 | 330(MAX) | 483 | YES |
| FEEDER 2 | A3 | 297 | 420 | NO |
| FEEDER 3 | A4R | 210 | 297 | NO |

(b)

| | SIZE | WIDTH | LENGTH | CLEANING |
|---|---|---|---|---|
| FEEDER 1 | A3 | 297(MAX) | 420 | YES |
| FEEDER 2 | A4 | 297(MAX) | 210 | YES |
| FEEDER 3 | A4R | 210 | 297 | NO |

FIG.6

| SIZE | 330＊483 | A3 | A4 | B6 |
|---|---|---|---|---|
| LENGTH Lc | 483 | 420 | 210 | 128 |
| LENGTH Lf | 440 | 440 | 440 | 440 |
| Lf / Lc | 0.91 | 1.05 | 2.10 | 3.44 |
| Nf | 1 | 2 | 3 | 4 |

FIG.7

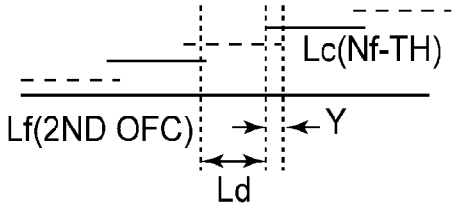

① WHEN OVERLAPPING PORTION IS Y,
(PAPER LENGTH) - 2Y = (PAPER INTERVAL)

$Y = (Lc-Ld)/2$

② (BELT LENGTH) = (PAPER NUMBER) x
(PAPER LENGTH) - (PAPER NUMBER - 1) x Y $$Lf = NcLc-(Nc-1)(Lc-Ld)/2$$
$$Lf-NcLc = (Nc-1)(Ld-Lc)/2$$
$$2(Lf-NcLc)/(Nc-1) = Ld-Lc$$
$$Lc+2(Lf-NcLc)/(Nc-1) = Ld$$
$$Ld = Lc+2(Lf-NfLc)/(Nf-1)$$

FIG.10

(a)

| | SIZE | WIDTH | LENGTH | PAPER NUMBER | PAPER INTERVAL |
|---|---|---|---|---|---|
| FEEDER 1 | 330∗483 | 330(MAX) | 483 | ONE | - |
| FEEDER 2 | A3 | 297 | 420 | NO | NO |
| FEEDER 3 | A4R | 210 | 297 | NO | NO |

(b)

| | SIZE | WIDTH | LENGTH | PAPER NUMBER | PAPER INTERVAL |
|---|---|---|---|---|---|
| FEEDER 1 | A3 | 297(MAX) | 420 | TWO | 40 - 439mm |
| FEEDER 2 | A4 | 297(MAX) | 210 | THREE | 20 - 209mm |
| FEEDER 3 | A4R | 210 | 297 | NO | NO |

FIG.11

| | SPECIES | SIZE | PAPER NUMBER |
|---|---|---|---|
| FEEDER 1 | SPECIES A | A3 | TWO |
| FEEDER 2 | SPECIES B | A4 | THREE |
| FEEDER 3 | SPECIES C | A4R | NO |

FIG.12

(a)
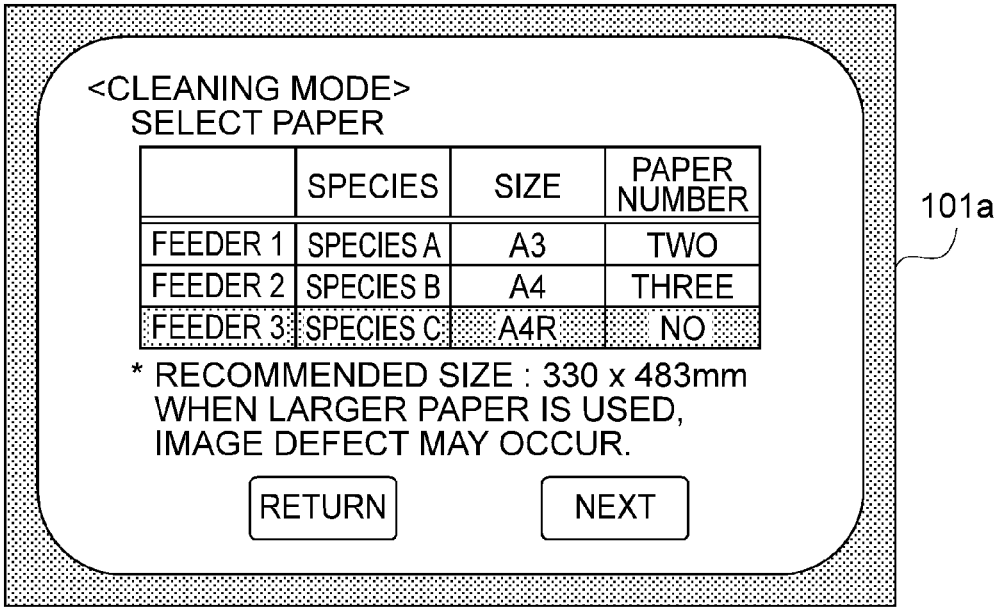
(b)
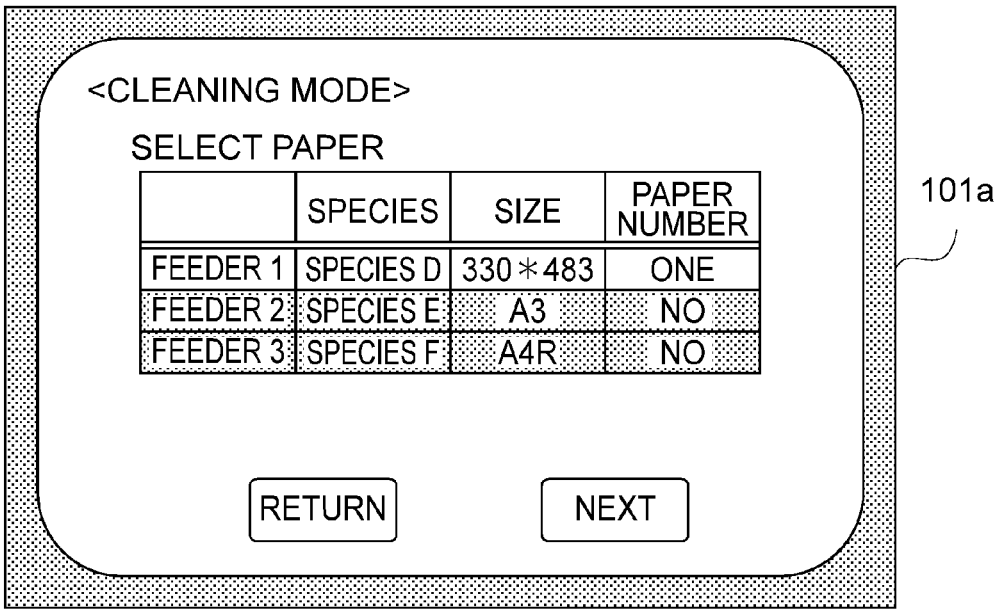
FIG.13

IMAGE FORMING APPARATUS WITH CLEANING MODE

FIELD OF THE INVENTION AND RELATED ART

The present invention relates to an image forming apparatus, such as a copying machine or a printer, of an electrophotographic type.

In the image forming apparatus, a fixing device (apparatus) for fixing a toner image formed on a recording material (sheet) is mounted. The fixing device includes a pair of rotatable members for nip-feeding the recording material.

As the recording material, in addition to plain paper, coated paper, an envelope, a postcard, a label, an OHP sheet and the like, there is a recording material containing calcium carbonate heavy as a filler. Specifically, in order to enhance a texture of the sheet, there is a tendency to increase a filling amount of the calcium carbonate for the reason that the resultant recording material has high whiteness and excellent opacity, while being inexpensive.

However, paper powder principally comprising calcium carbonate generating on such a sheet is liable to be electrostatically attracted to the surface of the rotatable member compared with paper power principally comprising another filler such as kaolin or talc.

In this way, when the paper powder is deposited on the surface of the rotatable member, a parting property at the surface of the rotatable member lowers remarkably. When the parting property lowers, a toner starts deposition gradually on the rotatable member, so that toner contamination is transferred onto the recording material and causes image defect.

Therefore, Japanese Laid-Open Patent Application Hei 2-160276 proposes a method in which a recording material on which a solid image is formed is used as cleaning paper since it is preferable that a depositing force of the toner is used.

However, in the case where a width size of the cleaning paper for cleaning the rotatable member is not proper, there is a liability that a degree of the cleaning of the rotatable member becomes unstable. Specifically, when the width size of the cleaning paper is small, the cleaning paper cannot contact a portion of the rotatable member where the paper power accumulates, so that there is a liability that removal of the paper powder cannot be carried out properly.

SUMMARY OF THE INVENTION

According to an aspect of the present invention, there is provided an image forming apparatus comprising: an image forming device configured to form a toner image on a sheet; a fixing device configured to fix the toner image formed on the sheet by the image forming device at a nip; an executing portion configured to execute an operation in a cleaning mode for cleaning the fixing device by forming a predetermined toner image on a sheet using the image forming device and then by introducing the sheet into the nip; and a notifying device for notifying an operator that a maximum-width sheet usable in the image forming device is to be used in the operation in the cleaning mode.

According to another aspect of the present invention, there is provided an image forming apparatus comprising: a plurality of accommodating devices each configured to accommodate a sheet; an image forming device configured to form a toner image on a sheet fed from one of the accommodating devices; a fixing device configured to fix the toner image formed on the sheet by the image forming device at a nip; an executing portion configured to execute an operation in a cleaning mode for cleaning the fixing device by forming a predetermined toner image on a sheet using the image forming device and then by introducing the sheet into the nip; and a selector configured to select, as a sheet used in the operation in the cleaning mode, a maximum-width size sheet from the sheets accommodated in the accommodating devices.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

In FIG. 6, (*a*) and (*b*) are tables each for selecting cleaning paper at each of a plurality of sheet feeding portions in Embodiment 1.

FIG. 7 is a table showing lengths and a necessary number of sheets in the case where cleaning papers different in length are used in Embodiment 2.

FIG. 10 is a schematic view showing a calculation formula of the cleaning paper interval shown in FIG. 9 in Embodiment 2.

In FIG. 11, (*a*) and (*b*) are tables each showing a sheet interval of each of cleaning papers in Embodiment 2.

FIG. 12 is an example of cleaning paper information displayed at a display portion during cleaning in Embodiment 2.

In FIG. 13, (*a*) and (*b*) are examples of warning display on the display portion in Embodiment 2.

DESCRIPTION OF THE EMBODIMENTS

The present invention will be described based on embodiments below. These embodiments are preferred embodiments of the present invention, but the present invention is not limited to various constitutions described in these embodiments. That is, the constitutions described in the embodiments can be replaced with other known constitutions.

<Embodiment 1>

(Image Forming Apparatus)

Figure 1:
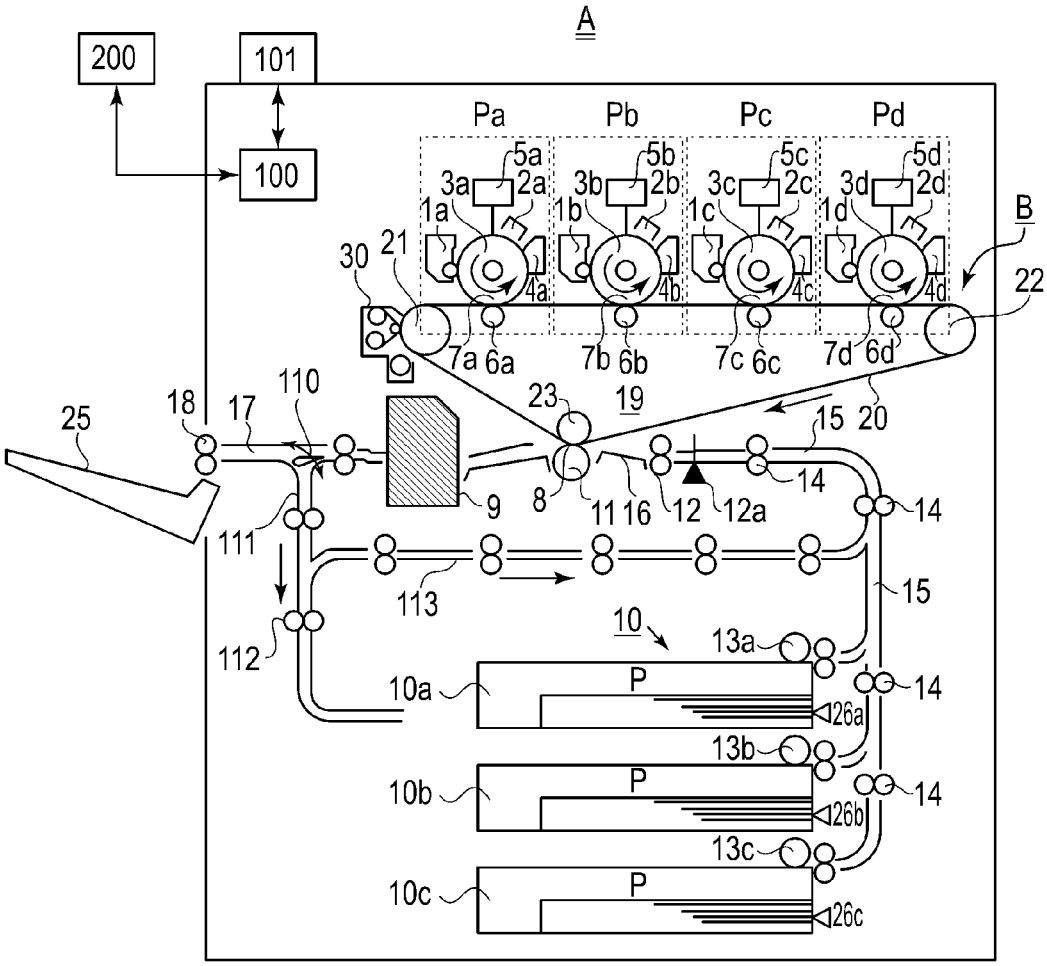
FIG. 1 is a schematic sectional view showing a structure of an image forming apparatus in Embodiment 1.

FIG. 1 is a schematic sectional view showing a structure of an example of an image forming apparatus A according to the present invention. The image forming apparatus A is a full-color laser beam. That is, the image forming apparatus A forms an image on a recording material (sheet) P on the basis of image information (electrical image signal) inputted from a host device 200 into a controller (executing device, selector: CPU) 100.

The controller 100 is a control means for effecting integrated control of an operation of the image forming apparatus A and transfers various electrical information signals between itself and the host device 200 or an operating portion (control panel) as a notifying device. In addition, the controller 100 effects processing of electrical information signals inputted from various process devices and sensors, processing of instruction signals inputted into the various process devices, predetermined initial sequence control and predetermined image forming sequence control.

The host device 200 is personal computer, a network, an image reader, a facsimile or the like. At the operating portion 101, a display portion (displaying device) 101*a* ((a) of FIG. 2) consisting of a main power switch, various operation keys and a liquid crystal display, and the like are provided.

Inside the image forming apparatus A, in FIG. 1, from left to right, first to fourth image forming units (image forming devices) Pa, Pb, Pc, Pd are provided. The image forming units Pa, Pb, Pc, Pd are electrophotographic image forming process mechanisms for forming toner images of different colors f cyan (C), magenta (M), yellow (Y) and black (Bk), respectively, in this embodiment.

The image forming units Pa, Pb, Pc, Pd include exclusive image bearing members, i.e., electrophotographic photosensitive drums 3*a*, 3*b*, 3*c*, 3*d*. Each of the drums 3*a*, 3*b*, 3*c*, 3*d* is rotationally driven in the counterclockwise direction indicated by an arrow at a predetermined peripheral speed.

At outer peripheries of the drums 3*a*, 3*b*, 3*c*, 3*d*, drum chargers 2*a*, 2*b*, 2*c*, 2*d*, developing devices 1*a*, 1*b*, 1*c*, 1*d*, primary transfer chargers 6*a*, 6*b*, 6*c*, 6*d* are cleaners 4*a*, 4*b*, 4*c*, 4*d* are provided, respectively. Above the drums 3*a*, 3*b*, 3*c*, 3*d*, laser scanners 5*a*, 5*b*, 5*c*, 5*d* are provided, respectively.

In the developing devices 1*a*, 1*b*, 1*c*, 1*d*, as developers, toners of C, M, Y, Bk are charged in predetermined amounts by unshown supplying devices. In each of the laser scanners 5*a*, 5*b*, 5*c*, 5*d*, unshown light source device and polygon mirror are provided. The drum surface is scanned with laser light emitted from the light source device by rotating the polygon mirror, and light flux of scanning light is deflected by a reflection mirror. Then the light flux is focused by an unshown fθ lens on a generatrix of each of the drums 3*a*, 3*b*, 3*c*, 3*d* electrically charged uniformly to a predetermined polarity and a predetermined potential by the chargers 2*a*, 2*b*, 2*c*, 2*d*.

As a result, latent images depending on image signals are formed on the drums 3*a*, 3*b*, 3*c*, 3*d* and then are developed by the developing devices 1*a*, 1*b*, 1*c*, 1*d* into the contact toner image, the M toner image, the Y toner image and the Bk toner image, respectively.

At a lower portion of the image forming units Pa, Pb, Pc, Pd, an intermediary transfer belt unit 19 is provided. The intermediary transfer belt unit 19 includes first to third (three) parallel rollers 21, 22, 23. The first roller 21 is disposed in the first image forming unit Pa side, the second roller 22 is disposed in the fourth image forming unit Pd side, and the third roller 23 is disposed below the first and second rollers 21 and 22 between the first and second rollers 21 and 22. The unit 19 further includes a flexible endless intermediary transfer belt 20 extended and stretched around these three rollers 21-23.

Inside the belt 20, between the first and second rollers 21 and 22, the roller-shaped primary transfer chargers 6*a*, 6*b*, 6*c*, 6*d* contact the belt 20 toward the drums 3*a*, 3*b*, 3*c*, 3*d* of the image forming units Pa, Pb, Pc, Pd, respectively. In the image forming units Pa, Pb, Pc, Pd, contact portions of the belt 20 with the drums 3*a*, 3*b*, 3*c*, 3*d* are primary transfer nips 7*a*, 7*b*, 7*c*, 7*d*, respectively. Toward the third roller 23, a secondary transfer roller 11 contacts the belt 20. A contact portion of the belt 20 with the secondary transfer roller 11 is a secondary transfer nip 8.

The belt 20 is rotationally driven in the clockwise direction of an arrow at the same peripheral speed as those of the drums 3*a*, 3*b*, 3*c*, 3*d*. To each of the primary transfer chargers 6*a*, 6*b*, 6*c*, 6*d*, a predetermined primary transfer bias is applied. By this primary transfer bias and nip pressure, onto the surface of the belt 20, the respective color toner images of C, M, Y, Bk are successively primary-transferred (intermediary-transferred) superposedly in a predetermined manner from the drums 3*a*, 3*b*, 3*c*, 3*d*.

The drums 3*a*, 3*b*, 3*c*, 3*d* are subjected to removal of transfer residual toners by the cleaners 4*a*, 4*b*, 4*c*, 4*d*, respectively and then prepare for subsequent latent image formation.

The superposed four color toner images (synthetic color toner image) are fed to the secondary transfer nip 8 by subsequent movement of the belt 20. To the secondary transfer nip 8, a sheet P as the recording material is fed from a sheet accommodating portion 10. In this embodiment, first to third sheet feeding cassettes 10*a*, 10*b*, 10*c* vertically provided as a plurality of sheet feeding portions.

Hereinafter, the first, second and third sheet feeding cassettes 10*a*, 10*b* and 10*c* are referred to as a sheet feeding portion 1, a sheet feeding portion 2 and a sheet feeding portion 3, respectively. In the sheet feeding portions 1 to 3, large to small sheets P different in width size (longitudinal width) with respect to a direction perpendicular to a sheet feeding direction are stacked and accommodated.

Figure 2:
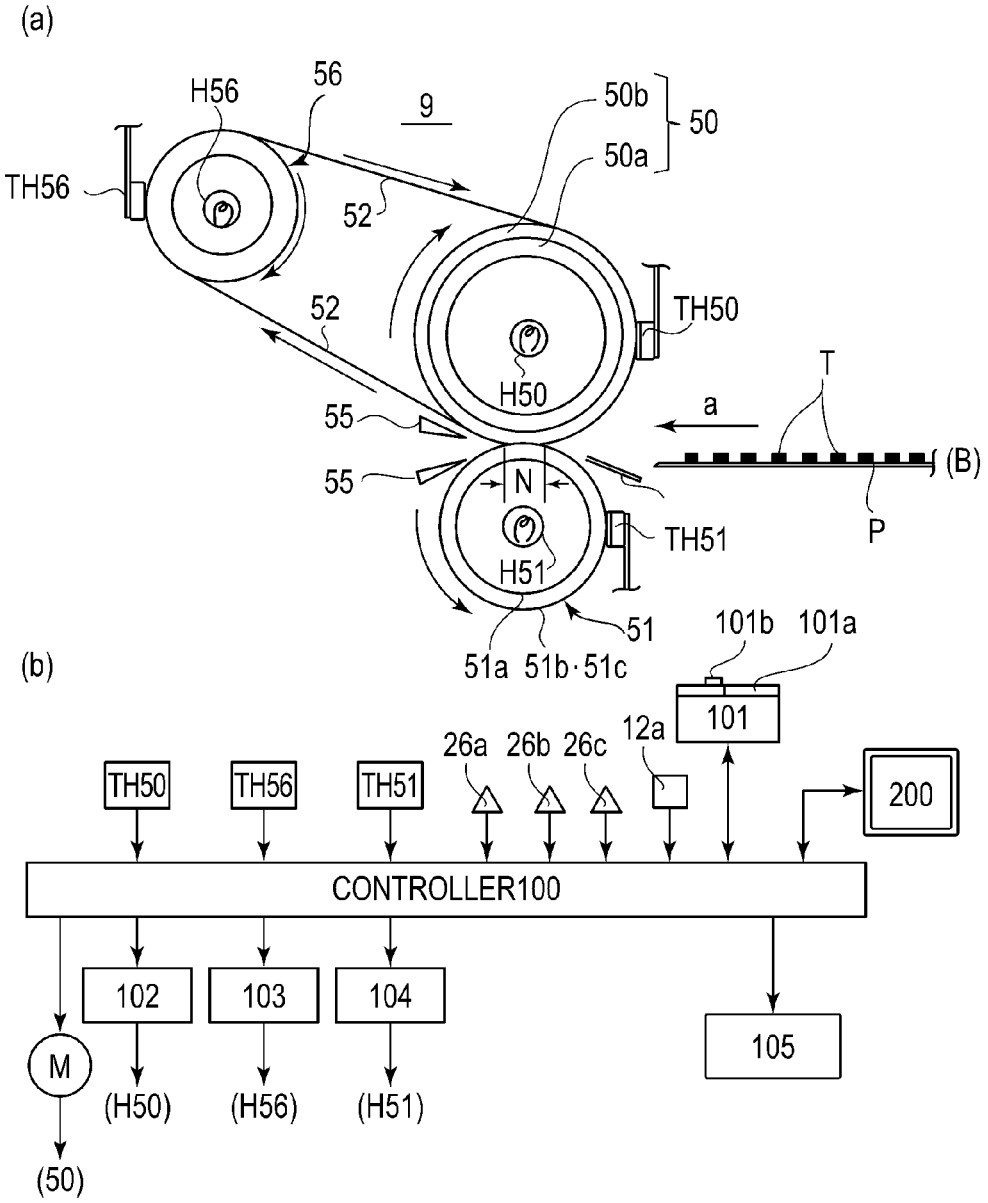
In FIG. 2, (*a*) is a schematic cross-sectional view showing a structure of a principal part of a fixing device in Embodiment 1, and (*b*) is a block diagram of a control system in Embodiment 1.

Pieces of size information on the sheets P accommodated in the sheet feeding portions 1 to 3 are inputted from sensors 26*a*, 26*b*, 26*c* (FIG. 1 and (b) of FIG. 2) as recording material size detecting mechanisms provided correspondingly to the sheet feeding portions 1 to 3, respectively, into the controller 100.

A user can select and designate a sheet having a desired size used in a print job or an operation in a cleaning mode of a fixing device 9 described later from the display portion 101*a* of the operating portion 101 or an operating portion of the host device 200 toward the controller 100.

When the print job is inputted, the controller 100 drives a feeding roller 13*a*, 13*b* or 13*c* corresponding to the sheet feeding portion accommodating the sheets P having the selected and designated size. As a result, the sheets P are fed one by one from the sheet feeding portion for which the feeding roller is driven and pass through a feeding path 15 including a feeding roller 14, so that the sheet P is fed to a registration roller pair 12. In this embodiment, feeding and conveyance of the sheet P is made by so-called center(-line)-basis feeding using a width center (line) of the sheet P as a reference.

The registration roller pair 12 corrects oblique movement of the sheet P fed from the sheet feeding cassette and then introduces the sheet P into the secondary transfer nip 8 via a pre-transfer guide 16 at predetermined control timing. The predetermined control timing is control timing when a leading end of the toner image formed on the belt 20 and a leading end of the sheet P reach the transfer nip 8 simultaneously with each other and are introduced into the transfer nip 8.

A registration sensor 12*a* detects that the leading end of the sheet fed from the sheet feeding portion or a leading end of a sheet fed from a path 113 for double-side printing (double-side feeding) reaches the registration roller pair 12, and feeds back detection results to the controller 100.

The controller controls feeding timing of the sheet P fed by drive of the registration roller pair 12 on the basis of a sheet leading end detection signal inputted from the registration sensor 12*a*. In addition, the registration sensor 12*a* detects that a trailing end of the sheet P sent by the registration roller pair 12 passes through the registration roller pair 12. The controller 100 controls stop of the drive of the registration roller pair 12 on the basis of a sheet trailing end detection signal inputted from the registration sensor 12*a*.

The registration sensor 12*a* also functions as a detecting mechanism for detecting timing of passing of the sheet through a feeding nip N of the fixing device 9 described later. The controller 100 also functions as a control mechanism for controlling the timing of passing of the sheet through the fixing nip N of the fixing device 9.

Then, the sheet P timing-fed to the secondary transfer nip 8 by the registration roller pair 12 is nipped and fed through the secondary transfer nip 8. To the secondary transfer roller 11, a secondary transfer bias is applied. By this secondary transfer bias and nip pressure, the superposed four color toner images are collectively secondary-transferred from the belt 20 onto the sheet P. In this embodiment, the toner image is formed on the sheet P while leaving a certain margin from each of four sides of the sheet P.

The sheet P coming out of the secondary transfer nip 8 is separated from the surface of the belt 20 and is introduced into the fixing device 9, in which the toner image is fixed as a fixed image on the sheet P by heat and pressure. After separation of the sheet P, the toner and another foreign matter remaining on the belt 20 are wiped off in contact with a cleaning web (nonwoven fabric) 30.

In the case of an operation in a one-side printing mode, the sheet P on which the toner image is formed on one surface (first surface) and which comes out of the fixing device 6 passes through an upper surface side of a flapper 110 switched to a first attitude which is substantially horizontal and enters a discharging path 17, so that the sheet P is discharged onto a discharge tray 25 by a discharging roller pair 18.

In the case of an operation in a double-side printing mode, the sheet P on which the toner image is formed on one surface (first surface) and which comes out of the fixing device 6 is guided downward from a lower surface side of the flapper 110 switched from the first attitude to a second attitude which is directed obliquely upward and is introduced into a reversing path 111. The sheet P is reversed (switched back) by a reversing roller 112 and is introduced into a path 113 for double-side printing in which the sheet P is fed back to the feeding path 15 in a state in which the sheet P is turned upside down. Then, the sheet P is introduced again into the secondary transfer nip 8 (double-side feeding), and then is subjected to secondary transfer of the toner image on a second surface of the sheet P.

Thereafter, similarly as in the case of the one-side printing, the sheet P passes through a path including the upper surface side of the flapper 110 switched to the first attitude, the discharging path 17 and the discharging roller pair 18, so that the sheet P is discharged as a double-side print onto the discharge tray 25.

In the image forming apparatus A in this embodiment, the four image forming units Pa, Pb, Pc, Pd and the intermediary transfer belt unit 19 including the secondary transfer roller 11 constitute an image forming portion B for forming an unfixed toner image on the sheet P fed from the sheet accommodating portion 10. The reversing path 111 and the path 113 for double-side printing constitute a double-side feeding mechanism for forming the images on double surfaces (first and second surfaces) of the sheet P.

(Fixing Device)

In FIG. 2,(*a*) is a schematic cross-sectional view showing a structure of a principal part of the fixing device 9 in this embodiment, (*b*) is a block diagram of a control system. The fixing device 9 includes a pair of rotatable members for forming a nip N in which the sheet P fed from the image forming portion B is nipped and fed to heat-fix the toner image thereon. As the pair of rotatable members, in this embodiment, a heating belt 52 as a rotatable heating member (rotatable fixing member) and a pressing roller 51 as a rotatable pressing member.

The heating belt (fixing belt) 52 is a heat-resistant endless belt having flexibility and is stretched between two parallel rollers consisting of a fixing roller 50 and a tension roller 56 under a predetermined tension. The pressing roller 51 is disposed under the fixing roller 50 substantially in parallel to the fixing roller 50, and the fixing roller 50 and the pressing roller 51 are press-contacted to each other at predetermined pressure.

In this embodiment, the fixing belt 52 is prepared by coating a 60 μm-thick Ni belt base layer with a 300 μm-thick Si rubber layer as an elastic layer and then by coating an outer peripheral surface of the elastic layer with an about 50 μm-thick PFA tube as a parting layer. The fixing belt 52 is 140 mm in outer diameter (about 440 mm in full circumference) in a cylindrical free state.

The fixing roller 50 is 50 mm in outer diameter and is prepared by forming an about 12 mm-thick Si rubber layer 50*b* on a 12 mm -thick hollow Al core metal 50*a*. The fixing roller 50 is provided rotatably via bearing members relative to a frame portion of a fixing device casing (not shown) in one end side and the other end side with respect to a rotational axis direction thereof.

The tension roller 56 is a hollow Al roller smaller in outer diameter than the fixing roller 50. The tension roller 56 is provided rotatably relative to the frame portion of the fixing device casing and slidably in a spacing direction from the fixing roller 50 via bearing members in one end side and the other end side with respect to the rotational axis direction. The tension roller 56 is moved and urged by an elastic urging member (not shown) in the spacing direction from the fixing roller 50. As a result, the fixing belt 52 is placed in a stretched state.

The pressing roller 51 is 40 mm in outer diameter and is prepared by forming a 200 μm-thick silicone rubber layer 51*b* on a 12 mm-thick hollow Al core metal 51*a* and then by coating an outer peripheral surface of the silicone rubber layer with an about 50 μm-thick PFA tube 51*c* as a parting layer. The pressing roller 51 is provided rotatably relative to the frame portion of the fixing device casing via bearing members in one end side and the other end side with respect to the rotational axis direction thereof.

The fixing roller 50 and the pressing roller 51 are press-contacted to the fixing belt 52 at predetermined pressure against elasticity of the elastic layer 50*b* of the fixing roller 50, the elastic layer of the fixing belt 52 and the elastic layer 51*b* of the pressing roller 51. As a result, between the fixing roller 50 and the pressing roller 51, the fixing nip N having a predetermined width (short-side width) is formed with respect to a feeding direction a of the sheet P.

The fixing roller 50 is rotationally driven in the clockwise direction of an arrow at a predetermined peripheral speed by a driving mechanism M controlled by the controller 100. With the rotational drive of the fixing roller 50, the fixing belt 52 is rotated in the clockwise direction of arrows at a peripheral speed corresponding to the rotational peripheral speed of the fixing roller 50. The tension roller 56 is rotated by the rotation of the fixing belt 52. Also the pressing roller 51 is rotated by the rotation of the fixing belt 52 with a frictional force with the fixing belt 52 at the nip N.

At inner hollow portions of the core metals of the fixing roller 50, the tension roller 56 and the pressing roller 51, halogen heaters H50, H56 and H51 are inserted and disposed. The halogen heaters H50, H56 and H51 generate heat by being supplied with electric power from a power source portions 102, 103 and 104, respectively. As a result, the fixing roller 50, the tension roller 56 and the pressing roller 51 are internally heated.

A fixing operation of the fixing device 9 is as follows. The controller 100 turns on the driving mechanism M at predetermined control timing, thus rotating the fixing roller 50. By the rotation of the fixing roller 50, also the fixing belt 52, the tension roller 56 and the pressing roller 51 are rotated.

The controller 100 supplies electric power from the power source portions 102, 103, 104 to the halogen heaters H50, H56, H51, respectively, so that the fixing roller 50, the tension roller 56 and the pressing roller 51 are heated. The surface temperatures of the fixing roller 50, the tension roller 56 and the pressing roller 51 are detected by thermistors TH50, TH56, TH51, respectively, and then are fed back to the controller 100.

On the basis of these pieces of feed-back information, the controller 100 controls the fixing roller 50, the tension roller 56 and the pressing roller 51 so that the respective surface temperatures are increased to predetermined temperatures and are kept at the predetermined temperatures. That is, the controller 100 control electric power supply from the power source portions 102, 103, 104 to the halogen heaters H50, H56, H51, respectively.

The surface temperature is increased to the predetermined temperature and thus the fixing roller 50 is temperature-controlled. The fixing belt 52 is heated by the fixing roller 50, so that the surface temperature thereof becomes a temperature corresponding to the surface temperature of the fixing roller 50. The tension roller 56 and the pressing roller 51 are increased in temperature to a predetermined surface temperature set at a value smaller than the surface temperature of the fixing roller 50 and then is temperature-controlled.

In this state, the sheet P which is fed from the image forming portion B and which carriers thereon the unfixed toner image T is guided by a feeding guide 54 with an image surface upward and is introduced into the fixing device 9, and then enters the fixing nip N along the surface of the pressing roller 51 to be nipped and fed through the fixing nip N. The sheet P is nipped and fed through the fixing nip N while the image surface thereof on which the toner image is carried intimately contacts the surface of the fixing belt 52.

In this nip-feeding process, the unfixed toner image T is formed as the fixed image on the sheet surface by being heated by the fixing belt 52 heated by heat of the fixing roller 50 and by being pressed at nip pressure. A sheet portion passed through the fixing nip N is successively separated by a separation guide 55 from the surfaces of the fixing belt 52 and the pressing roller 51 at a sheet exit portion of the fixing nip N, so that the sheet P is fed and discharged from the fixing device 9.

By using the fixing belt 52, a peripheral length of the fixing member 52 can be made longer than a peripheral length of the fixing roller 50, so that uneven glossiness liable to generate when the peripheral length of the fixing member 52 is shorter than a length dimension of the sheet P with respect to the sheet feeding direction a can be alleviated. The uneven glossiness is such a phenomenon that in the case where the fixing member 52 rotates through not less than two full circumferences relative to the length of a single sheet, the fixing member temperature lowers in rotation through the second one-full circumference by which heat is taken than in rotation through the first one-full circumference and therefore a temperature difference of the fixing member 52 appears as a difference in glossiness.

(Cleaning Mode of Fixing Device)

Figure 3:
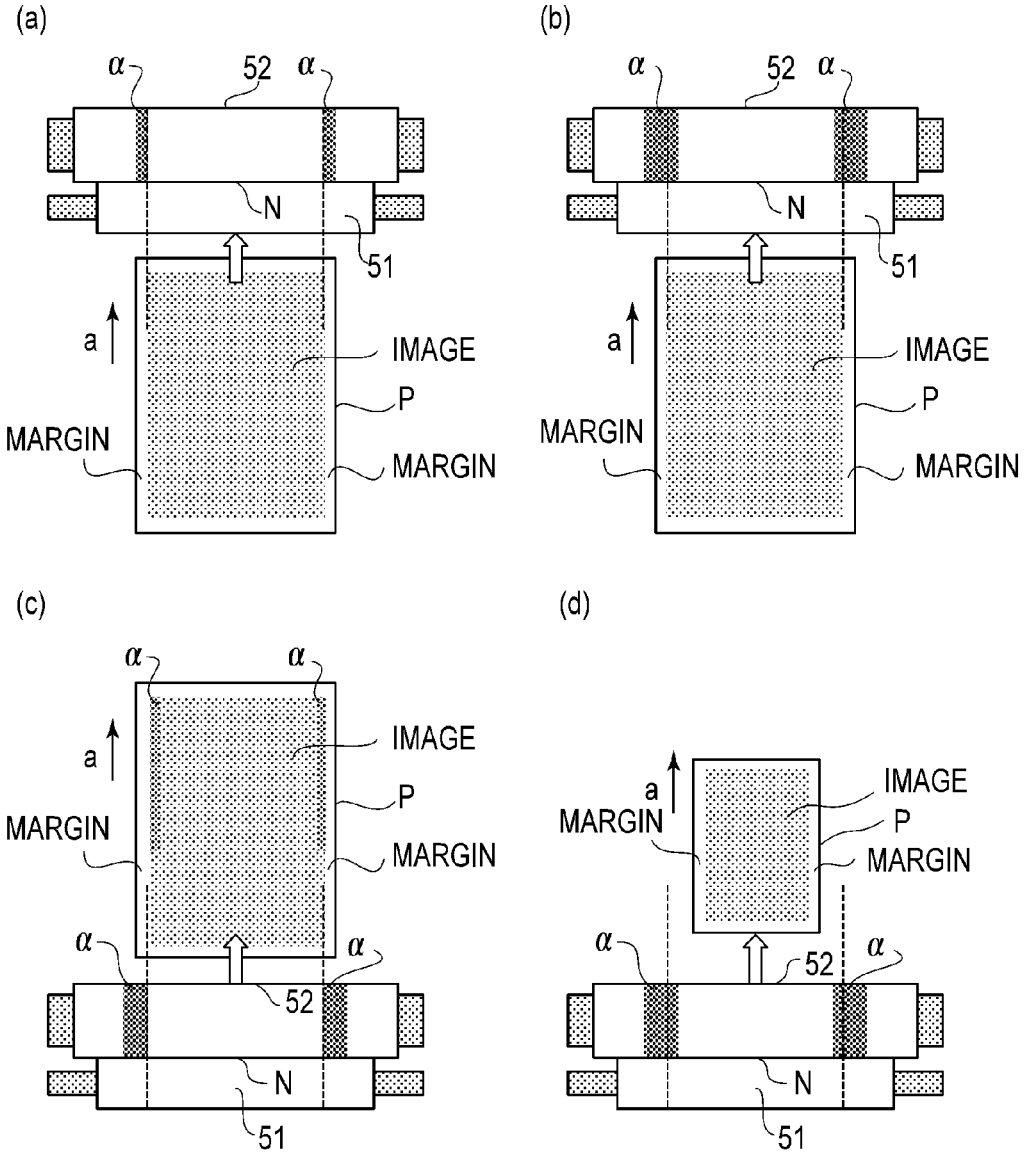
In FIG. 3, (*a*) to (*d*) are schematic views each showing a fixing belt contamination and a width of cleaning paper in Embodiment 1.

In FIG. 3,(*a*) to (*d*) are schematic views showing an outline of contamination of the fixing belt 52 which is a rotatable fixing member. As a cause of generation of the contamination of the fixing belt 52, it is possible to cite the following item. For example, calcium carbonate as an additive (filler) contained in the sheet P introduced into the fixing nip N has such a triboelectric charging characteristic that it is strongly charged positively by friction with the PFA tube as the surface layer of the fixing belt 52. For that reason, when the sheet P containing a calcium carbonate in a large amount passes through the fixing nip N, calcium carbonate is liable to be electrostatically attracted to the PFA tube at the surface of the fixing belt 52.

The surface of the fixing belt 52 where calcium carbonate is deposited is remarkably lowered in parting property, so that when the sheet P carrying thereon the toner image is passed through the fixing nip N, the toner is gradually accumulated from the sheet P onto the surface of the fixing belt 52 ((a) of FIG. 3). In (a) of FIG. 3, α schematically illustrates a state in which paper powder and calcium carbonate at each of margin portions with respect to a widthwise direction of the sheet P passed through the fixing nip N are deposited as toner contamination (contaminant) on the surface of the fixing belt 52.

This toner contamination α gradually grows along a longitudinal width direction of the fixing belt 52 as shown in (b) of FIG. 3 when the toner and the paper powder are supplied by subsequent sheets P which are passed through the fixing nip N and which have the same longitudinal width. When the contamination grows to some extent, as shown in (c) of FIG. 3, in the case where a sheet P having a width wider than a contamination width is passed through the fixing nip N, the contamination α is deposited on the image portion of the sheet P, so that the contamination α becomes a defective image.

The toner contamination α strongly adheres to the surface of the fixing belt 52, and therefore does not readily transfer onto the margin portions where there is no toner and the image region where the toner amount is small. For this reason, during an operation in the cleaning mode of the fixing belt 52, in order to remove the accumulated toner contamination α, it is possible to use, as a cleaning sheet (cleaning paper), the sheet P on which a cleaning image (predetermined image) is formed in a toner amount of not less than a predetermined amount (e.g., 0.4 mg/cm$^2$) in an entire image formable region.

In this embodiment, in the operation in the cleaning mode of the fixing belt 52, the sheet P is fed from the sheet accommodating portion 10 and at the image forming portion B, a solid image is formed as the predetermined image. The sheet P is introduced as the cleaning paper into the fixing device 9. Thus, the operation in the cleaning mode in which the surface of at least one of the rotatable fixing member 52 and the rotatable pressing member is cleaned based on the above-described principle is performed. This operation in the cleaning mode is executed by the controller (executing device) 100 on the basis of an execution instruction.

The operation in the cleaning mode can be executed by operation of an executing key 101*b* ((b) of FIG. 2) on the operating portion 101 by the user. The executing key 101*b* is a manually inputting means by which the user can arbitrarily input the execution instruction for executing the operation in the cleaning mode. In addition, the operation in the cleaning mode can be automatically executed on the basis of predetermined discrimination information. Alternatively, on the basis of the predetermined discrimination information, the controller 100 can cause the operating portion 101 or the display portion of the host device 200 to display a message for prompting the user to execute the operation in the cleaning mode.

With respect to the longitudinal width of the cleaning paper used in the operation in the cleaning mode, unless the longitudinal width is sufficiently broader than the contamination width of the fixing belt 52 or is the same width as a width size (longitudinal width) of the sheet on which the contamination generates to the minimum, the toner contamination α of the fixing belt 52 cannot be sufficiently removed ((d) of FIG. 3).

Figure 4:
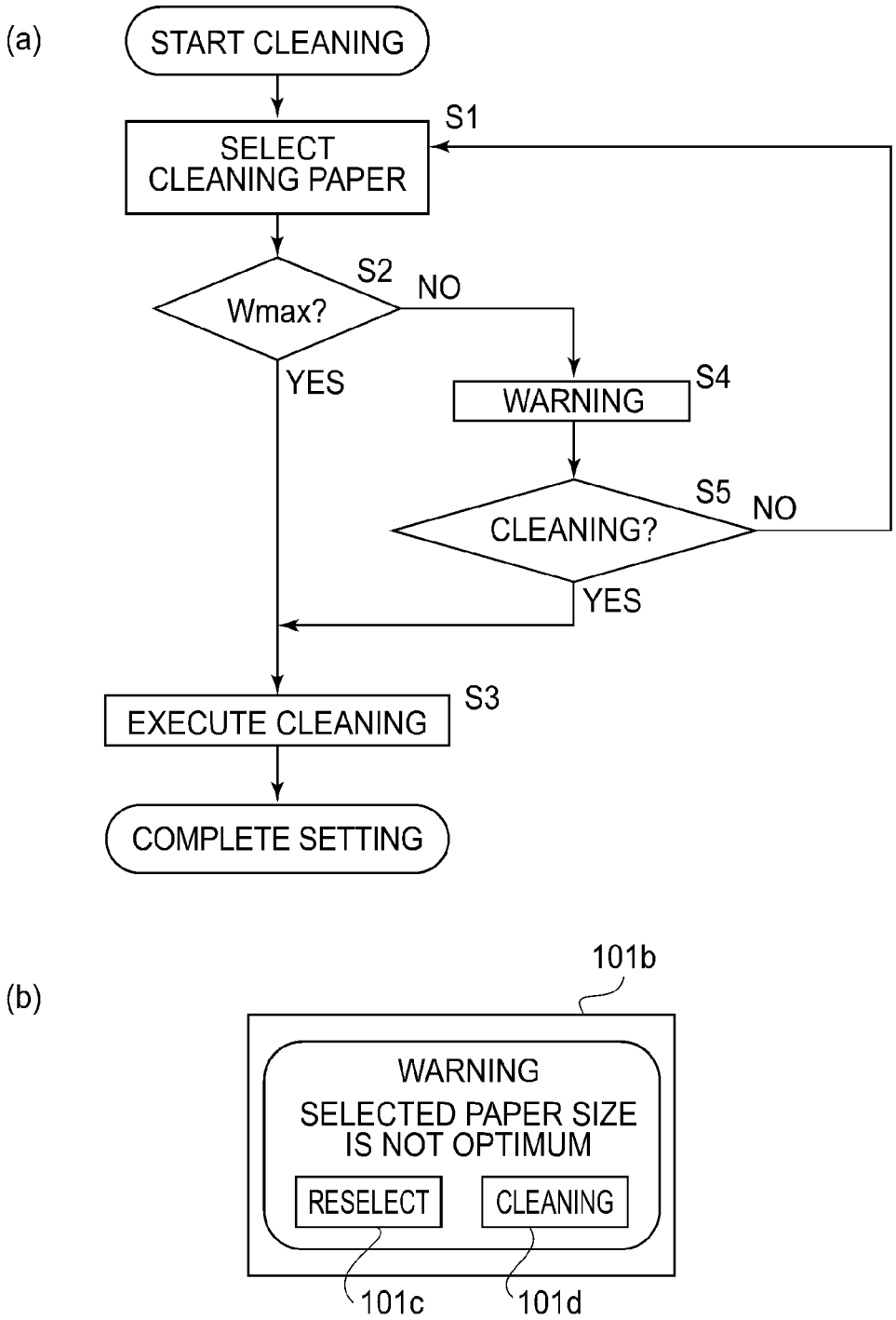
In FIG. 4, (*a*) is a control flowchart when an operation in a cleaning mode is started, and (*b*) is a display of warning.

Therefore, in this embodiment, control as shown in (a) and (b) of FIG. 4 is effected. Specifically, when the operation in the cleaning mode is started, the size of the sheet used as the cleaning paper is selected and designated through the display portion 101*a* of the operating portion 101 or the operating portion of the host device 200 and then is inputted into the controller 100. When the width size of the sheet is not a maximum width size Wmax, notification or display of warning to the effect that the sheet having the maximum width size Wmax is to be used is displayed on the display portion 101*b*.

Even in the case where the width dimension of the cleaning paper is satisfied, when the length of the cleaning paper with respect to the feeding direction is shorter than the circumferential length of the fixing belt 52 or the pressing roller 51 as an object to be cleaned, the toner contamination of the fixing belt 52 or the pressing roller 51 cannot be removed sufficiently. Therefore, in the case of starting the operation in the cleaning mode, also when a length L2 of the sheet selected and designated as the cleaning paper is not longer than a circumferential length L4 of the fixing belt 52 or the pressing roller 51, it is preferable that the notification to the display portion 101*b* or display of warning at the display portion 101*b* is made.

Figure 5:
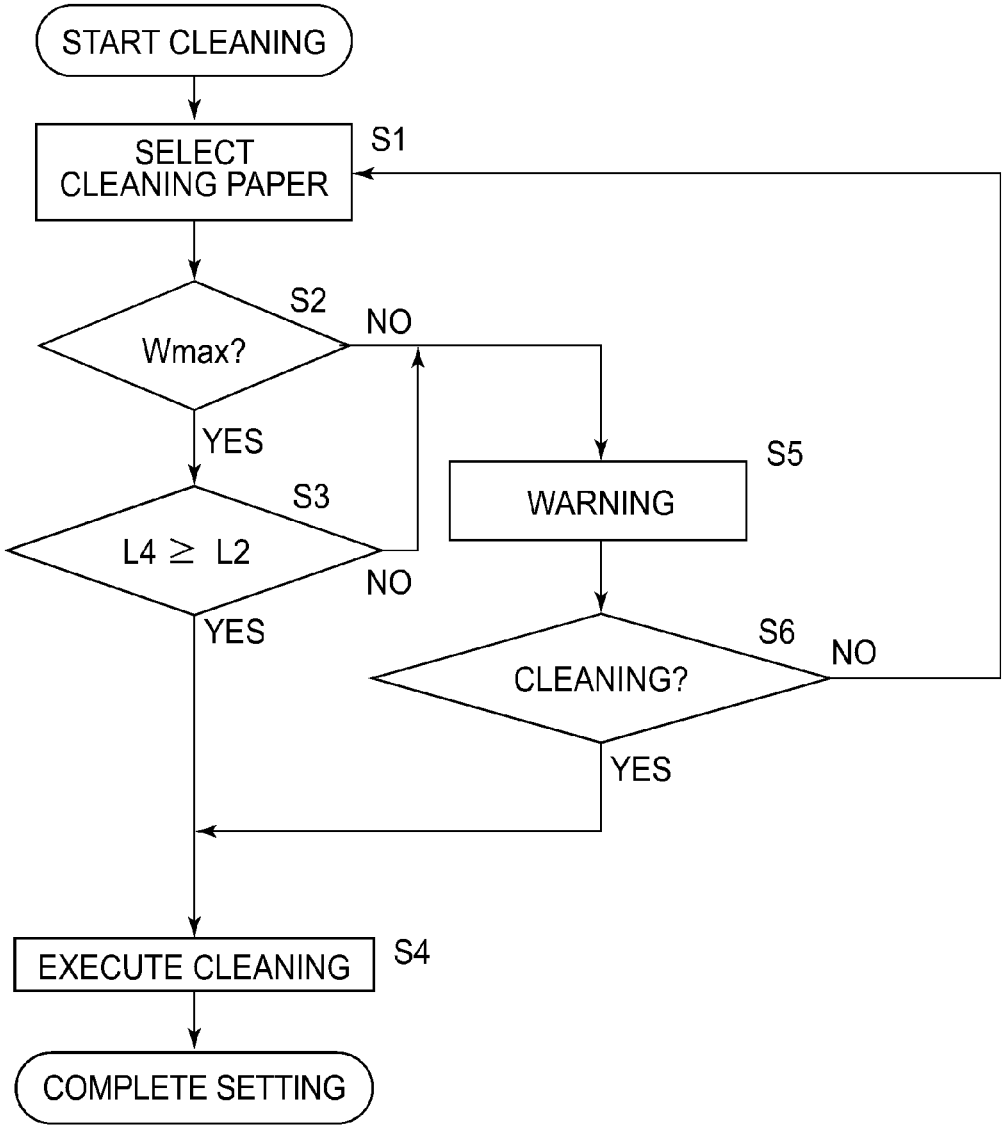
FIG. 5 is a control flowchart when an operation in a cleaning mode is started.

In (b) of FIG. 4, the display portion 101*b* displays warning in a step S4 in (a) of FIG. 4 and in a step S5 in FIG. 5. On the basis of this warning display, the user presses a sheet re-selection key 101*c* in the case of selecting the sheet again, and thus the sequence returns to a step S1, so that the cleaning paper having a proper size is selected again. In the case where the sheet having the proper size is not accommodated in each of the sheet feeding portions 1 to 3, the sheet having the proper size is accommodated in either of the sheet feeding portions 1 to 3 and then the sheet is selected again.

Pieces of size information of the sheets accommodated in the sheet feeding portions 1 to 3 are inputted from sensor 26*a*, 26*b*, 26*c* for the sheet feeding portions 1 to 3, respectively, into the controller 100. Therefore, in the operation in the cleaning mode, the controller 100 can perform an operation in such a control mode that from the sheets accommodated in these (plurality of) sheet feeding portions 1 to 3, the maximum-width sheet is automatically selected and fed as the cleaning paper to execute the operation in the cleaning mode.

Specifically, the maximum-width size sheet selected from the sheets accommodated in the three sheet feeding portions 1 to 3 as a plurality of sheet accommodating portions (recording material accommodating portions) shown in FIG. 1 is used. For example, as shown in FIG. 6, when sheet sizes are set for the sheet feeding portions 1 to 3, of the set width sizes, only the maximum width size, i.e., 330 mm in (a) of FIGS. 6 and 297 mm in (b) of FIG. 6 is selectable as the cleaning paper.

A toner image printing range (image formable region) in the operation in the cleaning mode may preferably be set so that the margin is minimized to achieve a cleaning effect of the fixing belt 52 in a broad range of the cleaning paper to the possible extent.

<Embodiment 2>

In recent years, the fixing belt 52 having a large diameter has been employed increasingly, and in some cases, a full circumferential length Lf of the fixing belt 52 is longer than a feeding direction length Lc of the sheet P. The sheet P is passed with the predetermined sheet interval Ld during not only the operation in the cleaning mode but also image formation (normal printing), and therefore only by rotation of the fixing belt 52 through one full circumference, a portion corresponding to the sheet interval Ld cannot be cleaned. For that reason, it is preferable that the cleaning paper is disposed (applied) with no gap with the fixing belt 52 by rotating the fixing belt 52 through 2 full circumferences at minimum.

At this time, in order to minimize the number of use of sheets of the cleaning paper, the number of use of the sheets can be mechanically determined by the full circumferential length Lf (about 440 mm in this embodiment) of the fixing belt 52 and the feeding direction length Lc of the cleaning paper. That is, it is preferable that the cleaning paper is prepared in an amount corresponding to the number of sheets obtained as an integer by raising a decimal of a numerical value of Lf/Lc to the next whole number (FIG. 7).

In the case where the number of use of sheets is intended to be minimized, the sheet interval Ld between consecutive two cleaning papers is required to be controlled to a certain range shown by the following relationship. For example, FIG. 7 shows the case where the full circumference portion of the fixing belt 52 can be cleaned by two sheets of the cleaning paper (cleaning paper length: 220 mm or more and less than 440 mm) such as the case where A3 (420 mm)-sized paper is used as the cleaning paper.

Figure 8:
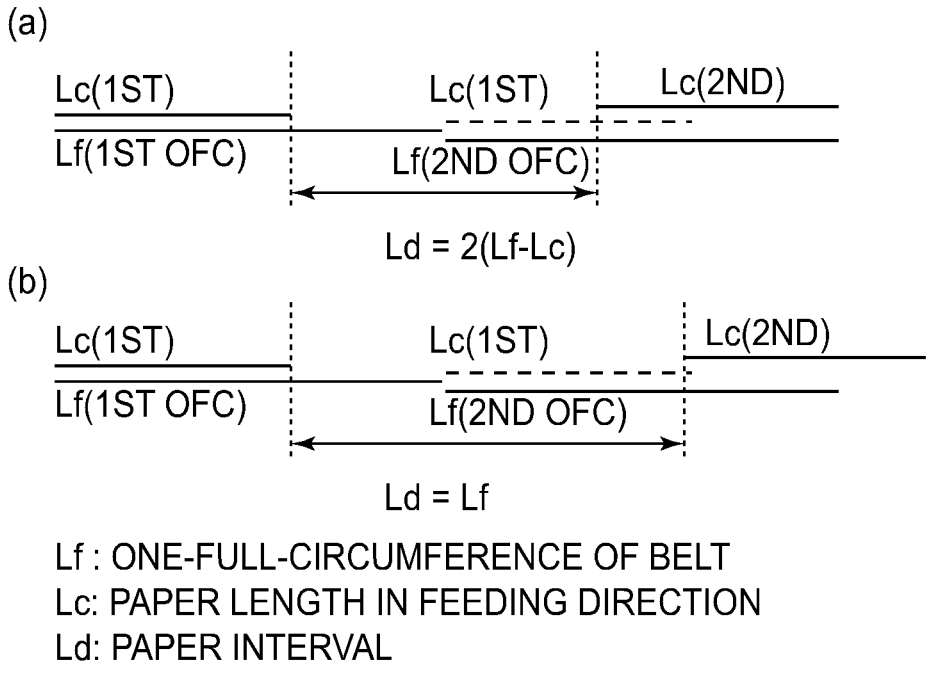
In FIG. 8, (*a*) and (*b*) are schematic views each showing cleaning paper interval in the case of two cleaning papers in Embodiment 2.

In this case, unless the sheet interval Ld between the two sheets of the cleaning paper is not less than twice (2 (Lf−Lc)) of a difference between the fixing belt length Lf and the cleaning paper length Lc as shown in (a) of FIG. 8, the cleaning papers cannot cover the full circumferential surface of the fixing belt. As shown in (b) of FIG. 8, when the sheet interval Ld is longer than the full circumferential length Lf, the cleaning papers cannot cover the full circumferential surface of the fixing belt.

Figure 9:
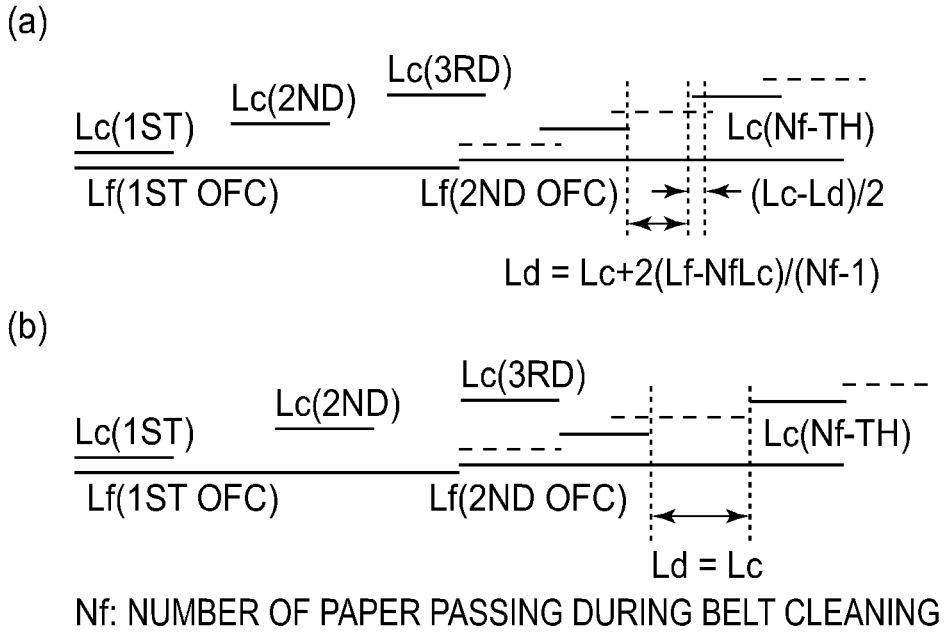
In FIG. 9, (*a*) and (*b*) are schematic views each showing cleaning paper interval in the case of three cleaning papers in Embodiment 2.

FIG. 9 shows a sheet interval Ld necessary in the case where the full circumferential surface of the fixing belt is cleaned by two or more sheets of the cleaning paper (3 sheets when the cleaning paper length of 147-219 mm, 4 sheets when the cleaning paper length of 110-146 mm). According to (a) of FIG. 9, the sheet interval Ld of the cleaning paper may preferably be the following relationship or more.

(Cleaning paper interval $Ld$)=(Cleaning paper length $Lc$)+2×((Full circumferential length $Lf$ of fixing belt 52)−(Sheet passing number $Nf$ of cleaning paper)×(Cleaning paper length $Lc$))/(Sheet passing number $Nf$ of cleaning paper)−1), i.e., $Ld=Lc+2(Lf-NfLc)/(Nf-1)$.

A calculation process is supplemented in FIG. 10. According to (b) of FIG. 9, it is understood that the cleaning paper interval Ld is required to be the cleaning paper length Lc or less.

Therefore, a constitution in which the sheet used in the operation in the cleaning mode is a maximum-width sheet of the sheets set and accommodated in the plurality of sheet feeding portions 1 to 3 and in which the sheet P passes through the nip N of the fixing device 9 by the number of times in which at least the following relational formula is satisfied in a single operation in the cleaning mode is employed. By this constitution, an entire region of a longitudinal width of the sheet usually used can be cleaned.

Nf=Lf/Lc (with the proviso that Nf is an integer and is obtained by rounding the decimal fraction up)

Nf: The number of times of passing of sheet P through nip N during operation in cleaning mode Lf: Full circumferential length of fixing belt 52

Lc: Feeding direction length of sheet P used in operation in cleaning mode

The image forming apparatus includes a detecting mechanism 12*a* for detecting timing of the sheet P passing through the nip N and the control mechanism 100 for controlling the timing of the sheet P passing through the nip N. In the case where a plurality of sheets are used in the single operation in the cleaning mode, the sheet interval in the operation in the cleaning mode is controlled so as to satisfy the following relationship. By employing such a constitution, the fixing belt full circumferential surface can be cleaned in the minimum sheet number and in a minute time (i.e., whole surface cleaning by rotation of the fixing belt through two full circumferences). That is, by controlling the sheet interval so as to satisfy the following relationship, in any case, the number of use of sheets can be made minimum.

Ld: Interval between sheets in operation in cleaning mode

When $Nf=2(Lc<Lf\leq 2Lc)$, $2(Lf-Lc)<Ld<Lf$.

When $Nf=3$ or more $(2Lc<Lf)$, $Lc+2(Lf-Nf\times Lc)/(Nf-1)<Ld<Lc$.

From the above result, as shown in FIG. 11, in the case where 3 species of sheets different in width size are accommodated in the sheet feeding portions 1 to 3, when the cleaning paper is selected, control is effected so as to provide the necessary sheet number of the cleaning paper and the cleaning paper interval Ld. This sheet interval control is effected by the detecting mechanism 12*a* for detecting the timing of passing of the sheet through the nip N and the control mechanism 100 for controlling the timing of passing of the sheet through the nip N. As a result, the fixing belt 52 can be efficiently cleaned by the minimum number of cleaning papers.

As a supplementary explanation, as shown in (b) of FIG. 11, the sheet interval Ld when the plurality of sheets are passed through the nip N can be set in a broad range, but there is no need to consciously change the sheet interval Ld in the case where the sheet interval (distance) during normal printing falls within the range. However, in order to minimize the number of sheets of the cleaning paper, in the case where the sheet interval is required to be changed from the sheet interval during the normal printing, it is desirable that the sheet interval Ld is made small so as not to be a sluggish interval between the first sheet to the final sheet since the cleaning time can be shortened.

Or, in the case where there is a margin at each of leading and trailing end portions of the sheet during the operation in the cleaning mode, cleaning efficiency is poor when there is no toner, and therefore the cleaning papers may preferably be superposed with each other and thus the sheet interval Ld of the cleaning papers may preferably be small.

In the case where there are a plurality of options as the cleaning paper as shown in (b) of FIG. 11, the user may arbitrarily select the species of the cleaning paper. However, it would be considered that either one of the species of the fed sheets is expensive and is improper for use as the cleaning paper from the viewpoint of cost. Therefore, it is further effective that the controller 100 controls the operating portion 101 so that the sheet information of the sheet feeding portions 1 to 3 and associated numbers of use of sheets in the operation in the cleaning mode are displayed at the display portion 101*a* and thus the user can select use of an associated one of the sheet feeding portions 1 to 3.

Even when any of sheets shown in FIG. 12 is selected, there is only a cleaning paper width of 297 mm for the fixing roller 52. For example, in the case where a maximum size of the sheets usable in the image forming apparatus is 330 mm×483 mm (13 inch×19 inch), when the sheet of 330 mm in width is used after execution of the operation, contamination generates on the image.

Therefore, in the case where the maximum-sized sheet is not set in the sheet feeding portions 1 to 3 during execution of the operation in the cleaning mode, the control 100 may preferably control the operating portion 101 so that a message that the maximum-sized sheets are not accommodated in the sheet feeding portions 1 to 3 is displayed at the display portion 101*a*. Or, the controller 100 controls the operating portion 101 so that a message that the contamination can generate during use of the sheet having a width size of the sheet used in the operation in the cleaning mode is displayed at the display portion 101*a*. As an example, a display example at the display portion 101*a* is shown in FIG. 13.

As described above, in this embodiment, the display portion 101*a* and the operating portion 101 which are used for selecting the sheet P for executing the operation in the cleaning mode are provided. During execution of the operation in the cleaning mode, as shown in (a) and (b) of FIG. 13, the sheet feeding portion in which the sheets usable in the operation in the cleaning mode are accommodated and the number of sheets used with respect to the sheet feeding portion during the operation in the cleaning mode are displayed at the display portion 101*a*, and the sheet feeding portion used is selectable through the operating portion 101.

<Embodiment 3>

In this embodiment, the case where contamination is accumulated on the pressing roller 51 as the rotatable pressing member will be described. Redundant explanation of the image forming apparatus, the fixing device and the like with Embodiments 1 and 2 will be omitted.

(Cleaning Mode of Fixing Device)

Figure 14:
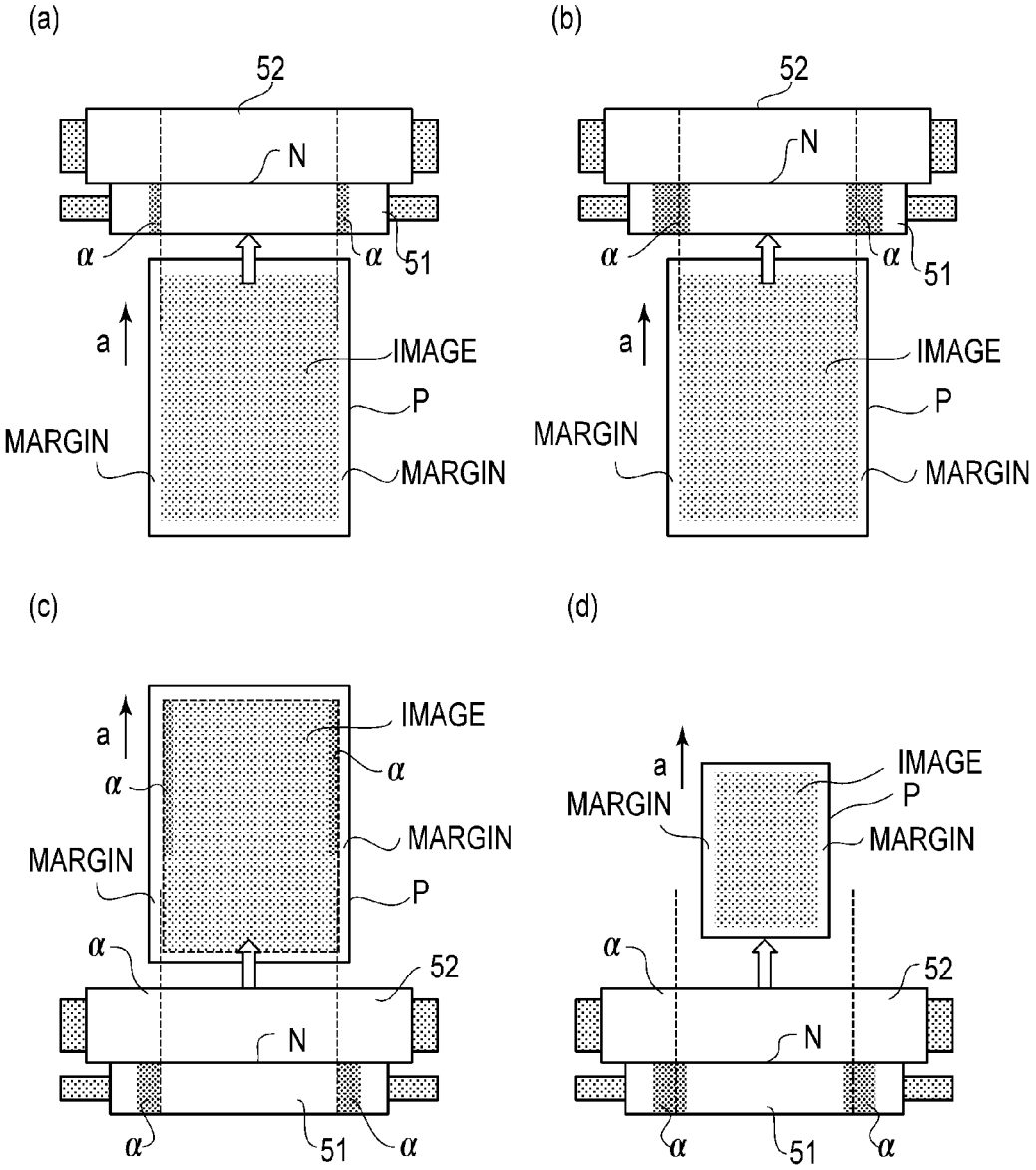
In FIG. 14, (*a*) to (*d*) are schematic views each showing pressing roller contamination and a width of cleaning paper in Embodiment 3.

FIG. 14 is a schematic view showing an outline of pressing roller contamination in this embodiment. The fact that calcium carbonate contained in the sheet is the accommodation cause of the contamination of the fixing belt 52 is common to Embodiments 1 and 3. The pressing roller contamination is generated by transfer of the toner contamination from the fixing belt 52 onto the pressing roller 51 in the sheet interval or the like ((a) of FIG. 14). Also a contamination (contaminant) α of the pressing roller 51 gradually grows in the longitudinal direction ((b) of FIG. 14). During the one-side printing, there is no toner image in the pressing roller 51 side, and therefore the sheet is not contaminated, but during the double-side printing, an image defect is generated by deposition of the pressing roller contamination α on the first surface where the image surface contacts the pressing roller 15 ((c) of FIG. 14).

Accordingly, it is desirable that the contamination is removed from the pressing roller 51 by carrying out the operation in the cleaning mode. Also in this case, the pressing roller contamination α with the toner cannot be removed sufficiently when the longitudinal width of the cleaning paper used in the operation in the cleaning mode is sufficiently broader than the contamination width of the pressing roller 51 or is the same as the width size (longitudinal width) of the sheet on which the contamination generates at the minimum ((d) of FIG. 14).

A proper width as the width of the cleaning paper is similar to that during the cleaning of the fixing belt 52, and there is a need to select the species of the maximum-width paper (sheet) from the sheets accommodated in the image forming portions 1 to 3. In addition, as an amount of the cleaning paper necessary for the cleaning mode, it is preferable that the cleaning paper is prepared in an amount corresponding to the number of sheets obtained as an integer by rounding up the decimal fraction of a numerical value obtained by dividing the pressing roller circumferential length by the cleaning paper length.

During the operation in the cleaning mode of the pressing roller 51, it is preferable that a predetermined image (solid image) is placed on the first surface of the sheet in the double-side printing or that the sheet on which a predetermined toner image is fixed in the one-side printing is disposed as the cleaning paper so that the image surface thereof contacts the pressing roller 51 during the feeding.

In the case of effecting the cleaning in the double-side printing, depending on the sheet size, the first surface and the second surface thereof is not always passed through the nip N with regularity, and therefore it is difficult to determine the sheet interval. However, based on the same manner of consideration as that in the cleaning of the fixing belt 52 in the case where the cleaning paper prepared in advance is disposed so as to contact the pressing roller and is subjected to the one-side printing, the cleaning paper interval may be determined. At this time, the relational formula in Embodiment 1 is usable as it is by replacing the fixing belt circumferential length with the pressing roller circumferential length.

Figure 15:
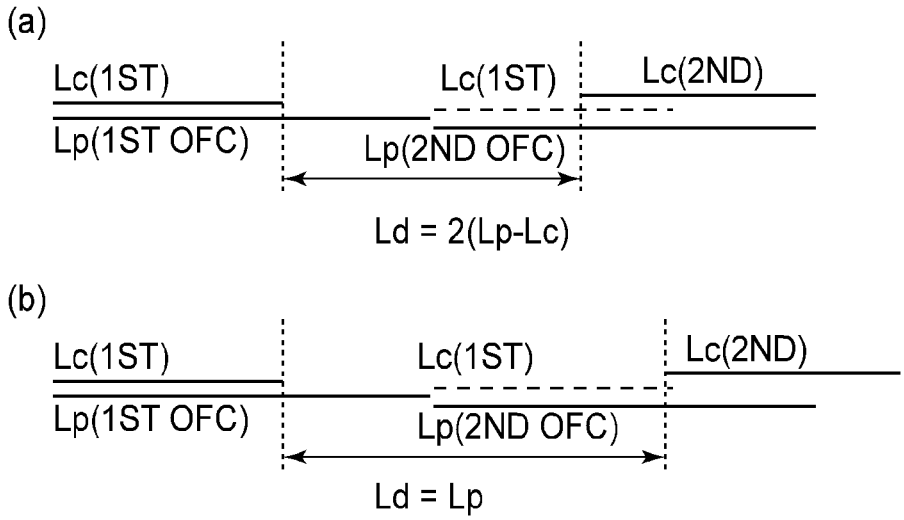
In FIG. 15, (*a*) and (*b*) are schematic views each showing cleaning paper interval in the case of two cleaning papers in Embodiment 3.
Figure 16:
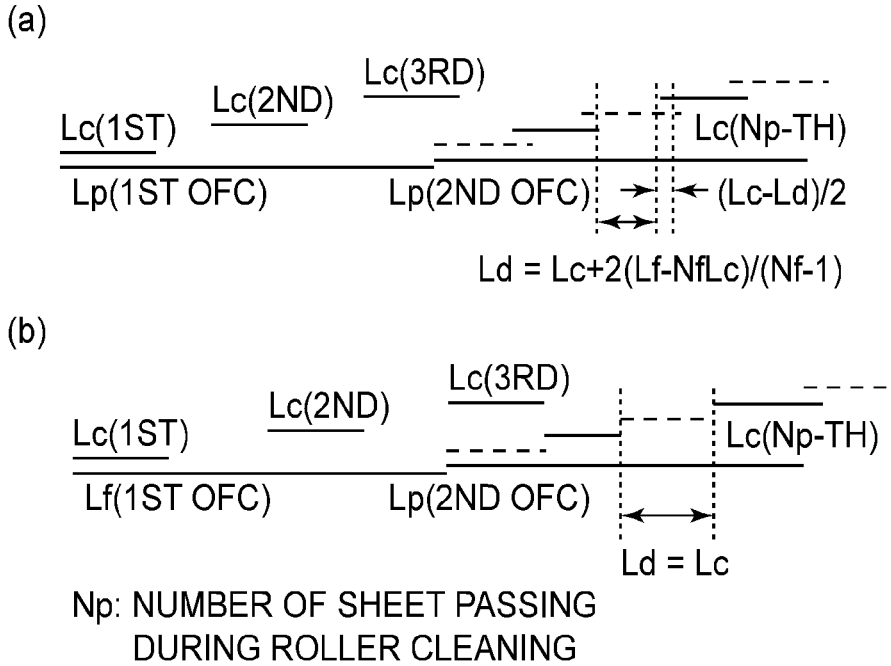
In FIG. 16, (*a*) and (*b*) are schematic views each showing cleaning paper interval in the case of three cleaning papers in Embodiment 3.

FIGS. 15 and 16 show sheet intervals each in the case where as the cleaning paper, the cleaning paper on which the toner image is fixed in advance is subjected to one-side passing so as to press-contact the pressing roller 51 in the operation in the cleaning mode of the pressing roller 51. In the following, the relational formula in Embodiment 1 is described as the cleaning of the pressing roller 51 by replacing the fixing belt 52 with the pressing roller 51.

(1) A constitution in which the sheet used in the operation in the cleaning mode is a maximum-width sheet of the sheets accommodated in the plurality of sheet feeding portions 1 to 3 and in which the sheet P subjected to the double-side printing is used by the number of times in which at least the following relational formula is satisfied in a single operation in the cleaning mode is employed. By this constitution, it is possible to meet also the case where the contamination generated on the pressing roller 51.

Np=Lp/Lc (with the proviso that Np is an integer and is obtained by rounding the decimal fraction up)

Np: The number of sheets used at least in operation in pressing roller cleaning mode Lp: Pressing roller circumferential length Lc: Feeding direction length of sheet P used in operation in cleaning mode (2) The image forming apparatus includes a detecting mechanism for detecting timing of the sheet P passing through the nip N and the control mechanism for controlling the timing of the sheet P passing through the nip N. The sheets used in the operation in the cleaning mode are accommodated in the sheet feeding portions so that the solid image fixed thereon contacts the pressing roller and are the maximum-width sheets of the sheets set for the sheet feeding portions. The sheets pass through the nip N by the number of sheets at least satisfying the following relational formula in the single operation in the cleaning mode.

Np=Lp/Lc (with the proviso that Np is an integer and is obtained by rounding the decimal fraction up)

Np: The number of sheets used at least in operation in pressing roller cleaning mode Lp: Pressing roller circumferential length Lc: Feeding direction length of sheet P used in operation in cleaning mode In the case where a plurality of sheets are used in the single operation in the cleaning mode, control is effected so that the sheet interval between two sheets in the operation in the cleaning mode satisfy the following relational formulas. By this constitution, it is possible to meet the case where the contamination of the pressing roller 51 generated.

When $Np=2(Lc<Lp\leq 2Lc)$, $2(Lp-Lc)<Ld<Lp$.

When $Np=3$ or more $(2Lc<Lp)$, $Lc+2(Lp-Np\times Lc)/(Np-1)<Ld<Lc$.

<Embodiment 4>

In the operation in the cleaning mode in each of Embodiments 1 to 3, the cleaning paper (sheet) introduced into the nip N can also be controlled so that the cleaning paper is moved (shifted) in a predetermined amount in each of one end side and the other end side with respect to the longitudinal width direction of the nip N. As a result, the contamination of the fixing belt 52 and the pressing roller 51 can be removed further satisfactorily.

(1) Control Example 1

Figure 17:
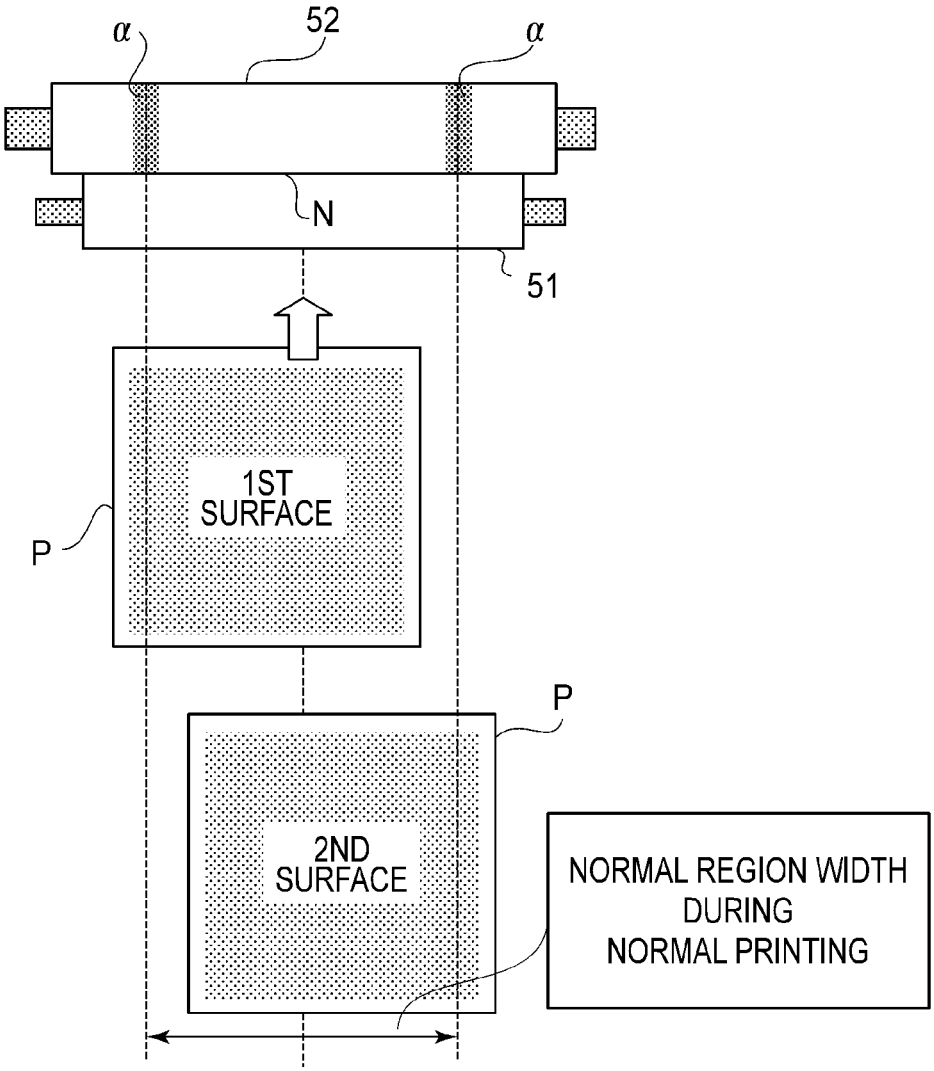
FIG. 17 is a schematic view of control example 1 in Embodiment 4.

In this control example 1, as shown in FIG. 17, a single cleaning paper P is subjected to double-side feeding, so that the cleaning paper P is passed two times through the fixing nip N. That is, in the operation in this cleaning mode, at the image forming portion B, the sheet on which the solid image (predetermined image) is formed is passed at least two times through the nip N of the fixing device 9.

The sheet P is shifted so that the positions of the sheet P relative to the nip N with respect to the longitudinal width direction during feeding of the sheet P having the image surface at the first surface (first feeding) and the second surface (second feeding) are moved in a predetermined amount in opposite directions in a disorder manner in one end side and the other end side with respect to the widthwise direction. This sheet shifting control is effected by, e.g., a sheet shifting mechanism 105 (position controlling mechanism: (b) of FIG. 2) which has an appropriate constitution and which is disposed upstream of the secondary transfer nip 8 with respect to the sheet feeding direction.

The sheet having the first surface and the second surface is a single sheet, and the sheet having the second surface as the image surface is a sheet which is the sheet having the first surface as the image surface passed through the nip N is turned upside down by the reversing path 111 and the path 113 for double-side printing and which is then fed and returned to the image forming portion B (double-side feeding).

The amount of relative movement between the nip N and the sheet P by the sheet shifting mechanism with respect to the widthwise direction in the above-described operation in the cleaning mode is larger than a minimum margin width of the sheet selectable during normal image formation in each of one end side and the other end side with respect to the widthwise direction.

As a result, it becomes possible to pass the cleaning paper P through a region outside the region through which the cleaning paper P passes during the normal image formation, and thus the image portion on the cleaning paper P can contact the toner contamination α on the fixing belt 52 with reliability, so that the toner contamination α can be removed satisfactorily.

(2) Control Example 2

Figure 18:
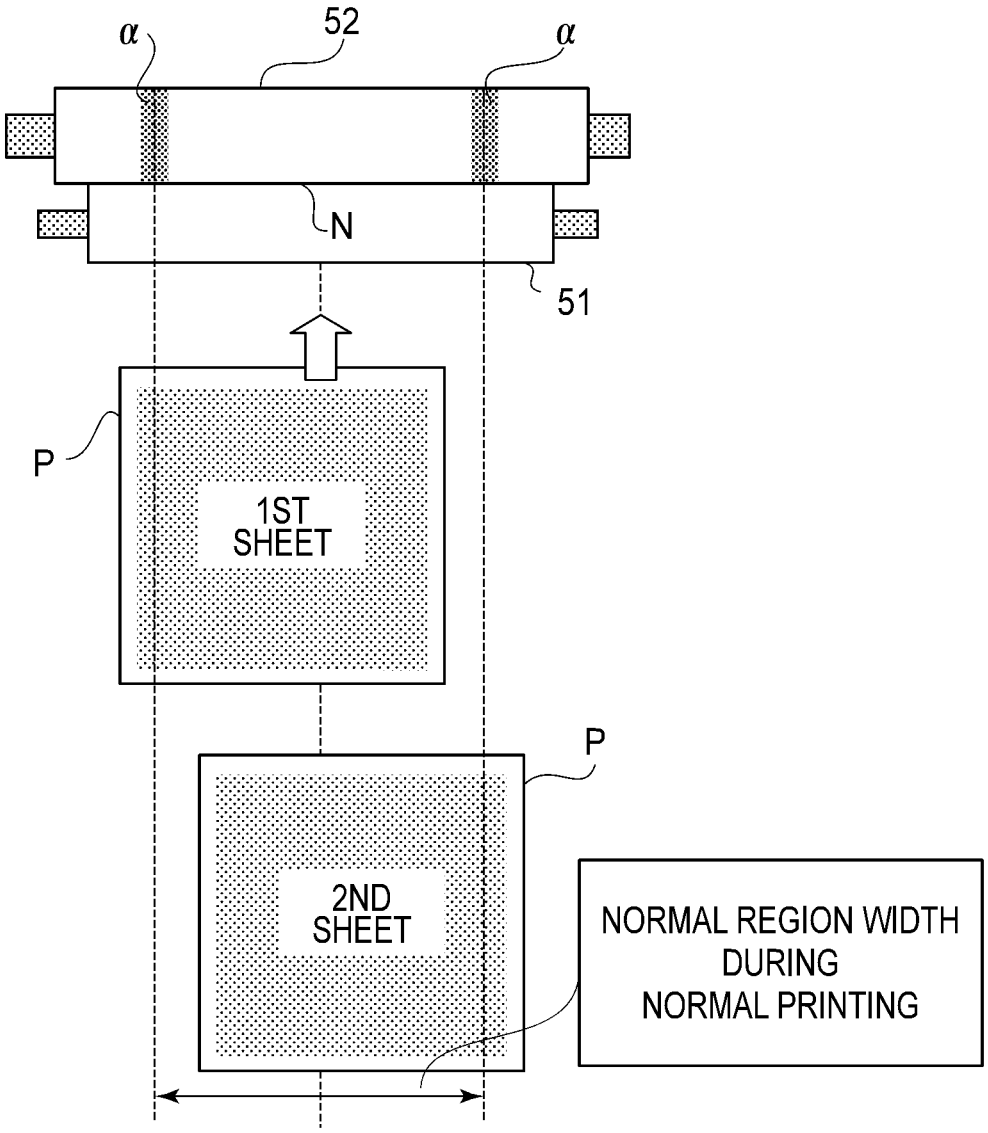
FIG. 18 is a schematic view of control example 2 in Embodiment 4.

In the image forming apparatus or the like in which there is no double-side feeding mechanism, a similar effect can be obtained even when a control system in which two cleaning papers P are successively subjected to one-side feeding as shown in FIG. 18. That is, in this control example 2, the sheets subjected to first feeding and second feeding, respectively, are separate (different) two sheets.

(3) Control Example 3

Figure 19:
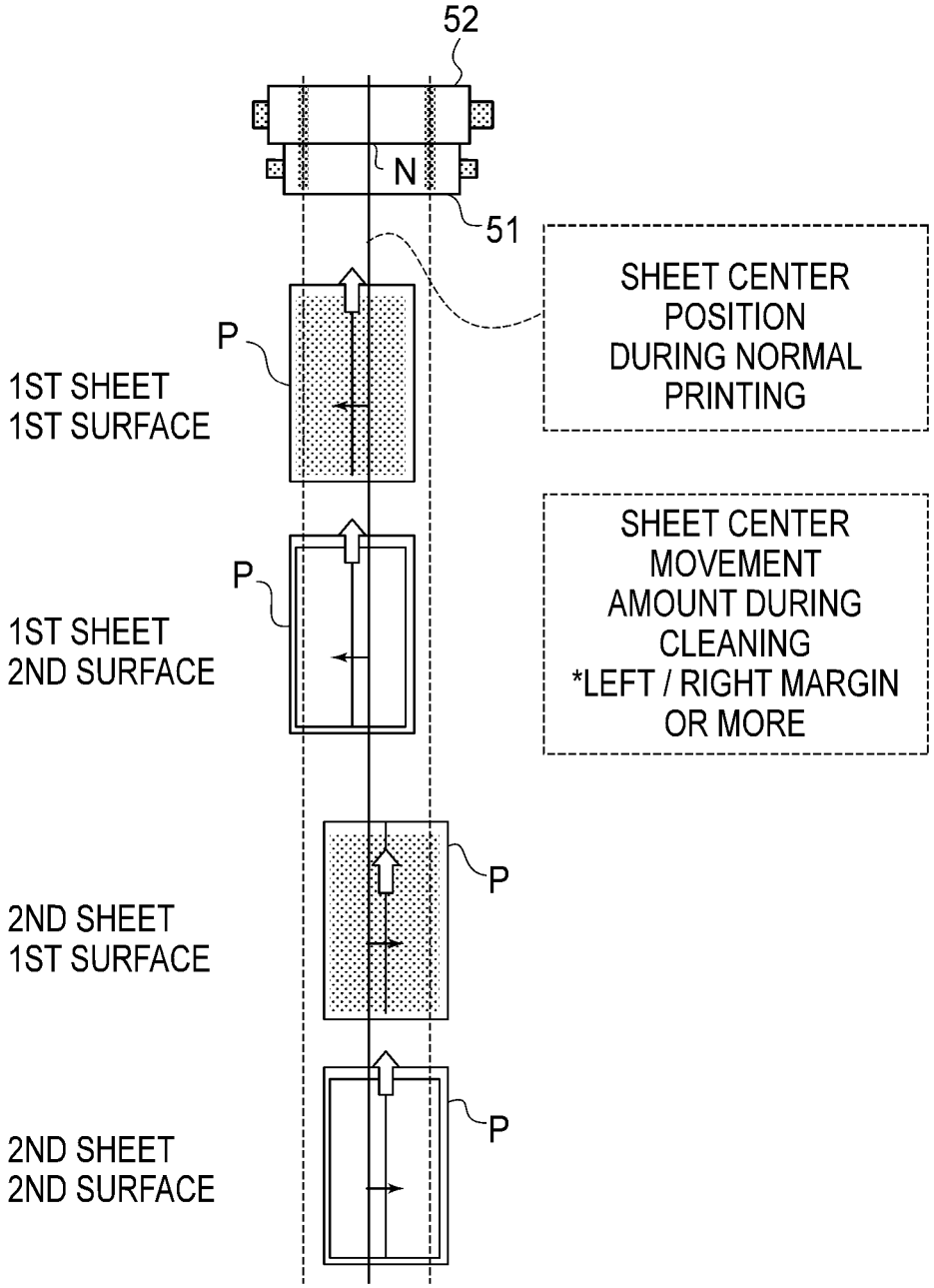
FIG. 19 is a schematic view of control example 3 in Embodiment 4.

In the control example 3, as shown in FIG. 19, each of the two cleaning papers P is subjected to the double-side feeding and thus the two cleaning papers are passed through the nip N four times in total, so that the toner contamination α deposited on the fixing belt 52 and the pressing roller 51 can be satisfactorily removed.

That is, in the operation in this cleaning mode, by a single execution instruction, at least two sheets each on which the solid image (predetermined image) is formed on the first surface at the image forming portion B are passed through the nip N at least four times in total by the double-side feeding. The sheet shifting mechanism 105 is controlled so that the relative positions of the first and second sheets during feeding are moved relative to the sheet feeding position during the normal image formation by a predetermined amount in one end side and the other end side, respectively, with respect to the widthwise direction.

In the operation in this cleaning mode, the relative movement amount between the nip N and the sheet with respect to the widthwise direction by the sheet shifting mechanism is larger than a maximum margin width of the sheet selectable during the normal image formation in each of one end side and the other end side with respect to the widthwise direction.

As a result, it becomes possible to pass the cleaning paper P through a region outside the region through which the cleaning paper P passes during the normal image formation, and thus the image portion on the cleaning paper P can contact the toner contamination α with reliability, so that the toner contamination α can be removed satisfactorily.

(4) Control Example 4

Figure 20:
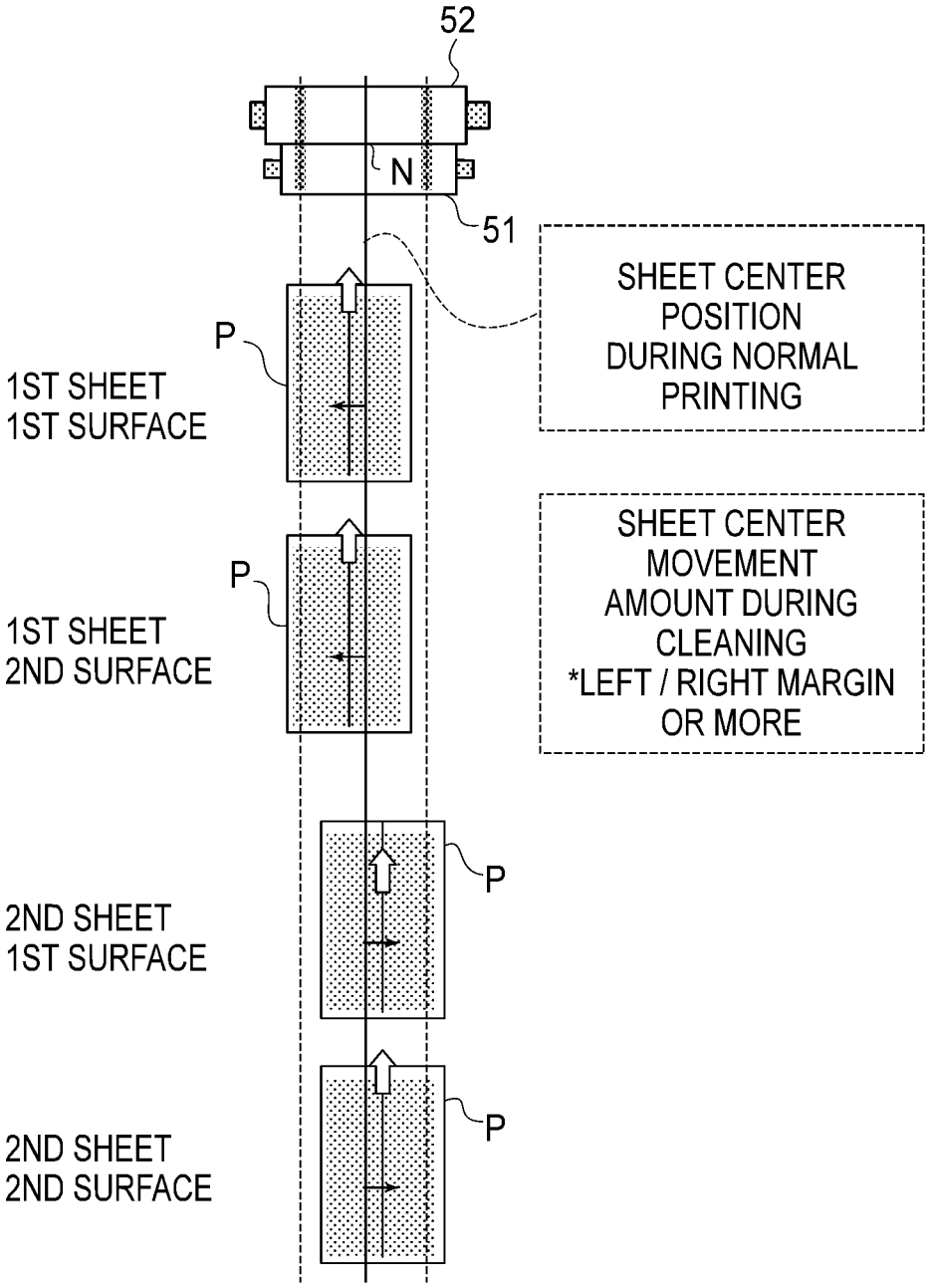
FIG. 20 is a schematic view of control example 4 in Embodiment 4.

In this control example 4, as shown in FIG. 20, the solid image (predetermined image) is formed on the first and second surfaces of each of the two sheets used in the above-described control example 3. That is, at least two cleaning papers P each on which the solid image is formed on each of the first and second surfaces are passed through the nip N at least four times in total by the double-side feeding.

In the control example 3, the solid image is formed only on the first surface, and the solid image portion on one surface is passed two times through the nip N, so that the surface contamination of both of the fixing belt 52 and the pressing roller 51 was removed.

As in this control example 4, in addition to the first surface, when the solid image is further formed on the second surface, in the fixing belt 52 side, the image surface of the cleaning paper P contacts the fixing belt 52 two times, so that the fixing belt 52 can be cleaned. For that reason, it is possible to remove also the contamination remaining on the fixing belt 52 without being not completely removed by single sheet feeding, so that it is possible to effectively clean the fixing belt 52 and the pressing roller 51.

<Other Embodiments>

(1) The image forming portion B for forming the unfixed toner image T on the recording material P is not limited to the image forming portion using an electrophotographic process. The image forming portion B may also be those using an electrostatic recording process and a magnetic recording process, respectively. The image forming portion B may also be the image forming portion for forming a monochromatic image. The type of the image forming portion is not limited to the transfer type, but may also be a direct type in which the toner image is formed using photosensitive paper or electrostatic recording paper as the recording material.

(2) The fixing device 9 may also have not only a device constitution in which the rotatable fixing member 52 is the roller and the rotatable pressing member 51 is the belt but also a device constitution in which both of the rotatable fixing member 52 and the rotatable pressing member 51 are rollers or belts.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-206273 filed on Oct. 7, 2014, which is hereby incorporated by reference herein in its entirety.

What is claimed is:

1. An image forming apparatus comprising:

an image forming device configured to form a toner image on a sheet;

a fixing device configured to fix the toner image formed on the sheet by said image forming device at a nip;

an executing portion configured to execute an operation in a cleaning mode for cleaning said fixing device by forming a predetermined toner image on a sheet using said image forming device and then by introducing the sheet into the nip; and a notifying device for notifying an operator that a maximum-width sheet usable in said image forming device is to be used in the operation in the cleaning mode.

2. An image forming apparatus according to claim 1, wherein in the operation in the cleaning mode, said executing portion successively introduces a first sheet and a second sheet into the nip so that a position of each of the first and second sheets relative to the nip shifts in a predetermined amount with respect to a longitudinal direction of the nip.

3. An image forming apparatus according to claim 2, wherein in the operation in the cleaning mode, said executing portion successively introduces the first and second sheets on which the toner image is formed into the nip and then introduces the first and second sheets again into the nip after the first and second sheets are turned upside down.

4. An image forming apparatus according to claim 2, wherein in the operation in the cleaning mode, and executing portion successively introduces the first and second sheets on which the toner image is formed into the nip and then discharges the first and second sheets to an outside of said image forming apparatus without introducing the first and second sheets into the nip again.

5. An image forming apparatus according to claim 2, further comprising a shifting device configured to shift the sheet to be introduced into the nip in the longitudinal direction, wherein said executing portion makes shift amounts of the first and second sheets different from each other.

6. An image forming apparatus according to claim 1, wherein the operation in the cleaning mode, said executing portion introduces the sheet on which the toner image is formed into the nip and then introduces the sheet into the nip after the sheet is turned upside down.

7. An image forming apparatus according to claim 1, wherein in the operation in the cleaning mode, said executing portion introduces the sheet on which the toner image is formed into the nip and then discharges the sheet to an outside of said image forming apparatus without introducing the sheet into the nip again.

8. An image forming apparatus according to claim 1, wherein said notifying device includes a displaying device for displaying a message for the operator.

9. An image forming apparatus according to claim 1, wherein the toner image has a toner amount per unit area which is not less than a predetermined amount in an entire image formable region of the sheet.

10. An image forming apparatus comprising:

a plurality of accommodating devices each configured to accommodate a sheet;

an image forming device configured to form a toner image on a sheet fed from one of said accommodating devices;

a fixing device configured to fix the toner image formed on the sheet by said image forming device at a nip;

an executing portion configured to execute an operation in a cleaning mode for cleaning said fixing device by forming a predetermined toner image on a sheet using said image forming device and then by introducing the sheet into the nip; and a selector configured to select, as a sheet used in the operation in the cleaning mode, a maximum-width size sheet from the sheets accommodated in said accommodating devices.

11. An image forming apparatus according to claim 10, wherein in the operation in the cleaning mode, said executing portion successively introduces a first sheet and a second sheet into the nip so that a position of each of the first and second sheets relative to the nip shifts in a predetermined amount with respect to a longitudinal direction of the nip.

12. An image forming apparatus according to claim 11, wherein in the operation in the cleaning mode, said executing portion successively introduces the first and second sheets on which the toner image is formed into the nip and then introduces the first and second sheets again into the nip after the first and second sheets are turned upside down.

13. An image forming apparatus according to claim 11, wherein in the operation in the cleaning mode, and executing portion successively introduces the first and second sheets on which the toner image is formed into the nip and then discharges the first and second sheets to an outside of said image forming apparatus without introducing the first and second sheets into the nip again.

14. An image forming apparatus according to claim 11, further comprising a shifting device configured to shift the sheet to be introduced into the nip in the longitudinal direction, wherein said executing portion makes shift amounts of the first and second sheets different from each other.

15. An image forming apparatus according to claim 10, wherein in the operation in the cleaning mode, said executing portion introduces the sheet on which the toner image is formed into the nip and then introduces the sheet into the nip after the sheet is turned upside down.

16. An image forming apparatus according to claim 10, wherein in the operation in the cleaning mode, said executing portion introduces the sheet on which the toner image is formed into the nip and then discharges the sheet to an outside of said image forming apparatus without introducing the sheet into the nip again.

17. An image forming apparatus according to claim 10, wherein the toner image has a toner amount per unit area which is not less than a predetermined amount in an entire image formable region of the sheet.

* * * * *